United States Patent [19]

O'Leary

[11] Patent Number: 4,745,712

[45] Date of Patent: May 24, 1988

[54] BUILDING SYSTEM FOR MULTI-STOREY BUILDINGS

[75] Inventor: Lawrence D. O'Leary, Croydon Park, Australia

[73] Assignee: Australian Stratacore Holdings Ltd., New South Wales, Australia

[21] Appl. No.: 928,457

[22] Filed: Nov. 10, 1986

[30] Foreign Application Priority Data

Nov. 15, 1985 [AU] Australia ..... PH03419

[51] Int. Cl.[4] ..... E04B 1/348

[52] U.S. Cl. ..... 52/34; 4/663; 4/664; 4/665; 52/79.13; 52/236.3

[58] Field of Search ..... 52/79.2, 234, 79.13, 52/364–366, 263, 34, 35, 79.1, 236.3; 4/613, 663, DIG. 7, 664, 665; 312/107; 206/499, 503, 509; 108/53.1, 53.3

[56] References Cited

U.S. PATENT DOCUMENTS

| | | | |
|---|---|---|---|
| 2,025,814 | 12/1935 | Goss | 4/613 |
| 2,168,725 | 8/1939 | Whelan | 4/663 |
| 2,197,874 | 4/1940 | Myers | 52/35 |
| 2,484,240 | 10/1949 | Morthland | 4/613 |
| 2,993,212 | 7/1961 | Ruhm | 52/34 |
| 3,015,407 | 1/1962 | Fesmire et al. | 206/509 |
| 3,292,327 | 12/1966 | Van Der Lely | 52/79.2 |
| 3,473,281 | 10/1969 | Omholt | 52/364 |
| 3,563,624 | 2/1971 | Stice | 312/107 |
| 3,824,750 | 7/1974 | Antoniou | 52/79.13 |
| 3,980,185 | 9/1976 | Cain | 206/509 |
| 4,010,579 | 3/1977 | Galvagni | 52/234 |
| 4,077,170 | 3/1978 | Van Der Lely | 52/263 |

FOREIGN PATENT DOCUMENTS

| | | | |
|---|---|---|---|
| 544452 | 7/1981 | Australia . | |
| 544461 | 7/1981 | Australia . | |
| 527842 | 12/1982 | Australia . | |
| 618870 | 12/1926 | France | 52/366 |
| 2070418 | 9/1981 | United Kingdom | 52/263 |

*Primary Examiner*—James L. Ridgill, Jr.

*Attorney, Agent, or Firm*—Cushman, Darby & Cushman

[57] ABSTRACT

A building system in which the wet areas are constructed as a module at a construction site and transported to be placed on site for a building to be erected therearound. The modules are constructed to be positioned one on another for multi-storied buildings and incorporated into the floors of the building.

8 Claims, 9 Drawing Sheets

BUILDING SYSTEM FOR MULTI-STOREY BUILDINGS

This invention relates to improvements relating to building systems, and more particularly to multi-storey buildings having a core unit of the wet area of the building.

DESCRIPTION OF PRIOR ART

In Australian Pat. Nos. 527,849; 544,452 and 544,461, there is described a method of erecting a building particularly a domestic building, including the steps of constructing a core unit of the wet area of the building, preparing a foundation of the building, transporting the core unit to the foundation, placing the core unit in position and then erecting the building around and/or about the core unit. This core unit becomes the basic core structure from which the rest of the home is built, the core unit incorporating the wet area rooms, such as the kitchen, bathroom, toilet and laundry, and this unit is constructed under factory conditions, and then delivered and placed on pre-prepared foundations at the home site.

In general, the core unit or module is fitted out with all the items desired or chosen by the owner and found in a site built home within the applicable area. For example the kitchens contain all cupboards, pantry, sink, cooker, tiles, flashbacks and fittings. Laundries contain the laundry tub, ceramic tile floors and skirtings and all fittings while the toilets are fitted out with a toilet suite, ceramic tile floors and skirtings and fittings. Similarly the bathrooms have the bath, shower recess and the basin and cabinet, ceramic tile floors and the whole core has all its electrical components and wirings fitted and wired to a sub-fuse box ready for connection. Similarly the plumbing is complete and also ready for interconnection at site.

The module is transported to site, and utilises beam or truss members to allow the module to be crane lifted and placed on site. The foundation on which the module is placed can either be a wooden foundaton, or can be a concrete slab.

The placement on the concrete slab in the prior patent specification could create some harm with connection of drainage points to waste disposal service pipes. Thus the methods outlined were two alternatives where one could either fit all disposal pipes above floor line and connected through walls, or by providing recesses in the slab for the clearance of pipe work when the module was lowered into position.

Multi-storey buildings utilising the module have been constructed. However, if a first module is placed in position and a concrete slab is provided for the floor above covering the first module, difficulties arise in positioning the second module and providing plumbing and other connections through the concrete slab floor.

It is an object of this invention to provide an alternate method whereby the module can be constructed in such a way that it can be incorporated into multi-storey buildings and yet still allow access to the underside for connection of services, sewage, drainage, water and the like.

STATEMENT OF THE INVENTION

Hence, there is provided according to the invention, a building system for multi-storey buildings with at least one of the above ground floors incorporating a wet area, including the provision of a module incorporating the wet area, each module utilising an integrated module support system that interlocks with a first module to provide support for a second module positioned above a first module.

In another aspect of the invention, there is provided a module for installation in a multi-storey building in which modules are stacked vertically above each other, each module at its upper perimeter incorporating a perimeter beam attached to the upper perimeter of the core unit, the perimeter beam forming the formwork for a surrounding concrete slab floor and interlocking therewith so that a further module may be positioned on the perimeter beam and thus supported thereon by the concrete slab floor.

DESCRIPTION OF THE PREFERRED EMBODIMENTS

Figure 1:
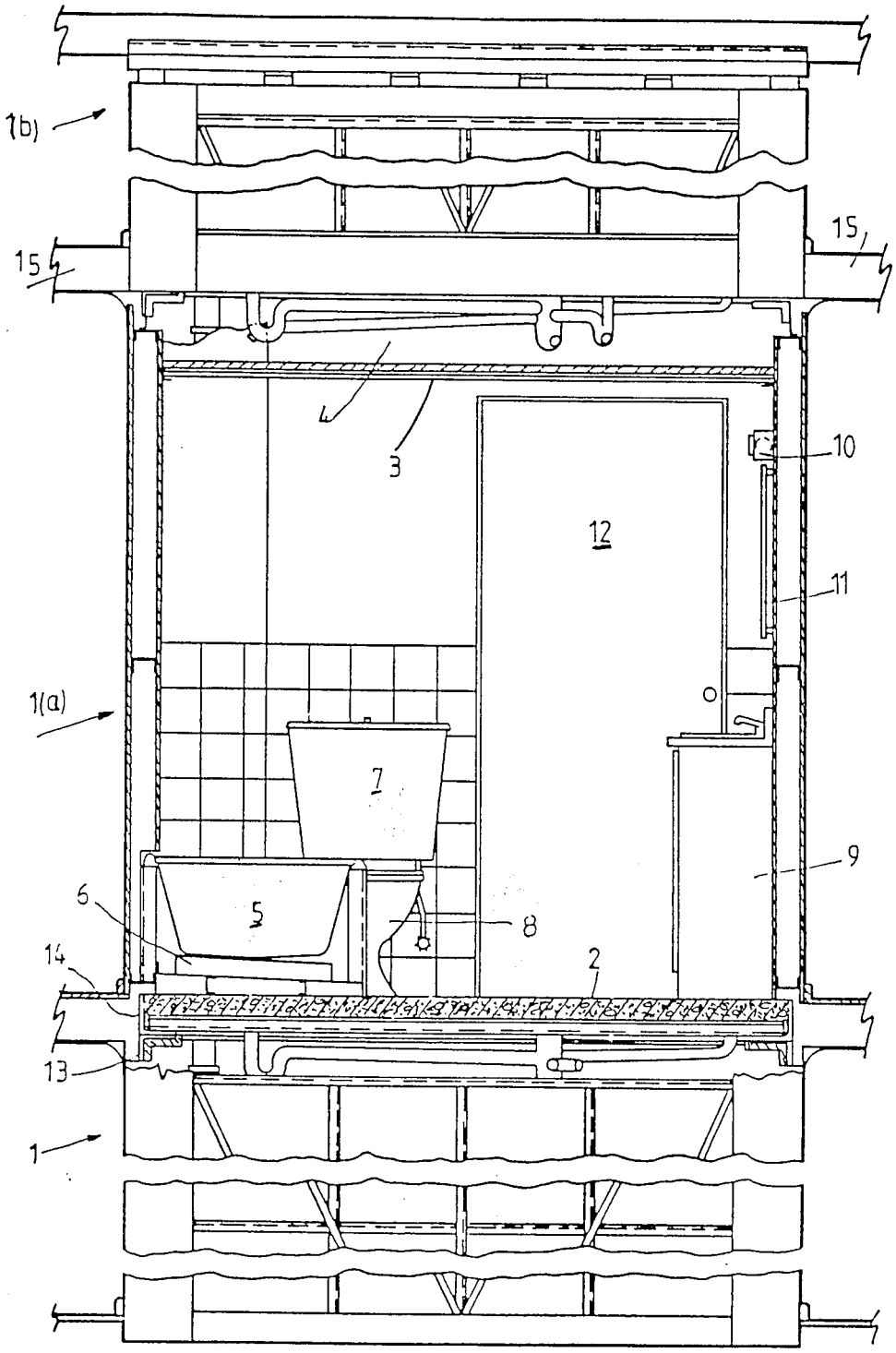
FIG. 1 shows in partial cross-section, three stacked modules, the centre one being in cross-section, the upper and lower modules being in side elevation.

Referring to the drawings, there is shown in FIG. 1 a lower module 1 on which is supported a second module 1(*a*) in turn supporting a further module 1(*b*). As shown in module 1, the module has a floor 2 and a false ceiling 3. The ceiling being positioned to allow a ceiling cavity 4 for the plumbing and drainage with ventilation for the module 1(*b*), and also the electrical services for module 1(*b*). A similar arrangement is provided for all modules, where a false ceiling provides access and space for the plumbing and drainage of the module immediately thereabove.

As shown, each module can comprise a bath 5 with a metal safe tray 6 therebeneath, cistern 7 and pan 8, vanity unit 9, light 10 and mirror 11, and a shower recess or alcove (not shown), and an entry door 12 providing access to the bathroom.

Each module has an upper frame 13 and a lower frame 14, these frames being joined together to unite one module to the next, the frame 14 of module 1 being mounted to a floor or the like of the building on the ground floor. As shown in FIG. 1, module 1 and module 1(*b*) are shown in broken form, these showing the outer construction of the modules. The floors for the adjoining rooms of the building are shown as concrete floors 15.

The modules are manufactured at a central location and transported to the site for erection. As noted above each module is produced fully equipped, with all the plumbing, electrical and internal fittings included so that on erection the plumbing and electrical services have merely to be connected.

Figure 2:
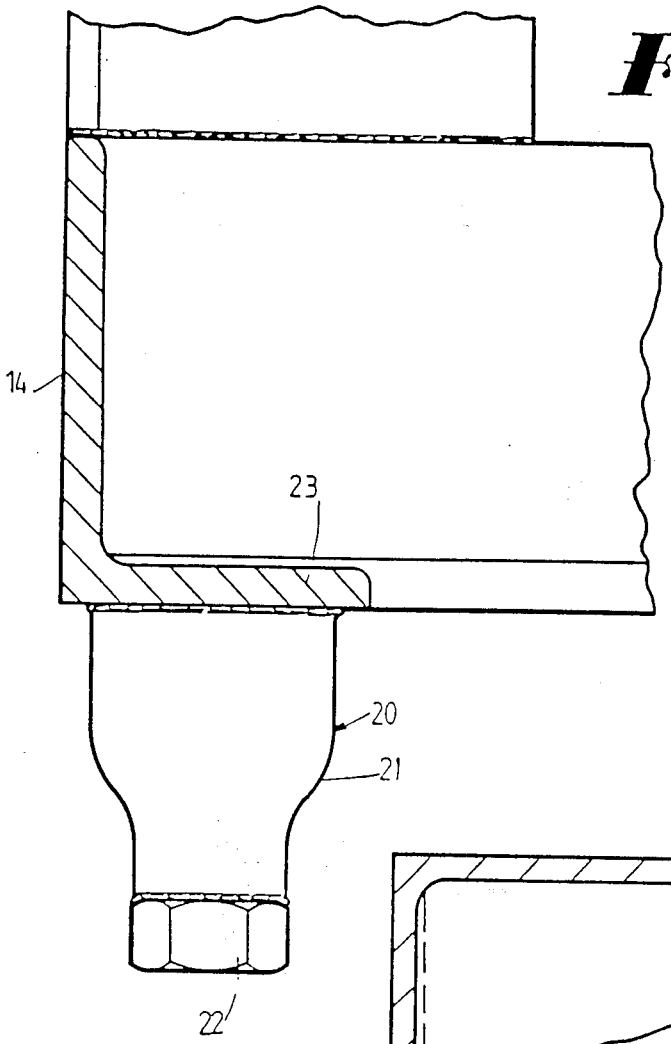
FIG. 2 shows a module corner base location.
Figure 4:
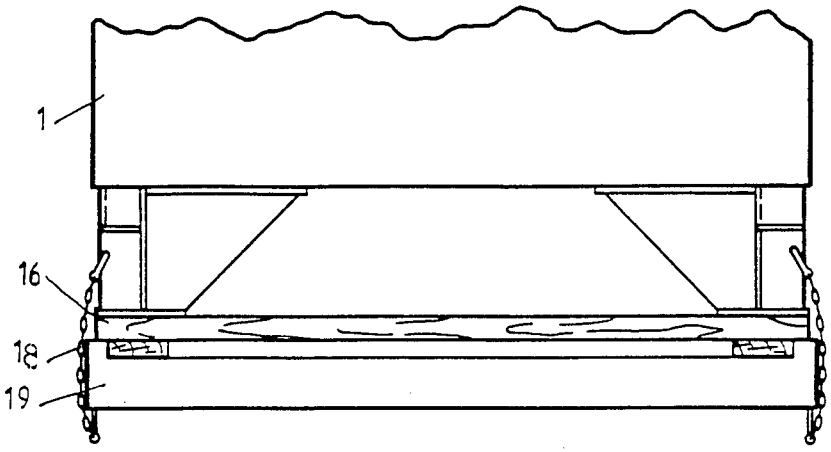
FIG. 4 shows a transport frame.
Figure 5:
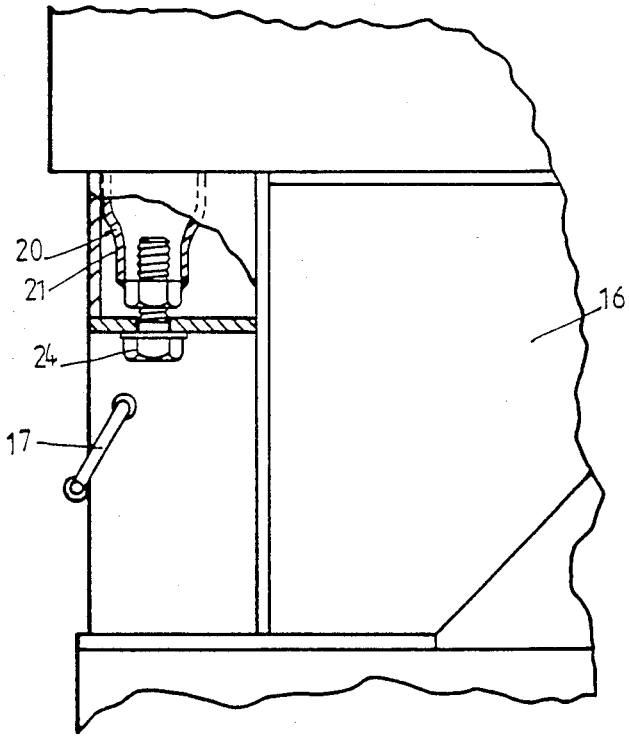
FIG. 5 shows a portion of the construction stand.

The modules 1 are manufactured on a stand 16 (FIGS. 4 and 5) the stand having a shackle 17 and chain 18 to hold the module down onto a transport stand 19. The modules have base locations 20 at each corner (one only being shown in FIG. 2) formed by a cylindrical reducer 21 having a nut 22 welded thereto, the reducer being welded to a base angle 23 on the module. A bolt 24 attaches the module to the construction stand 16.

Figure 3:
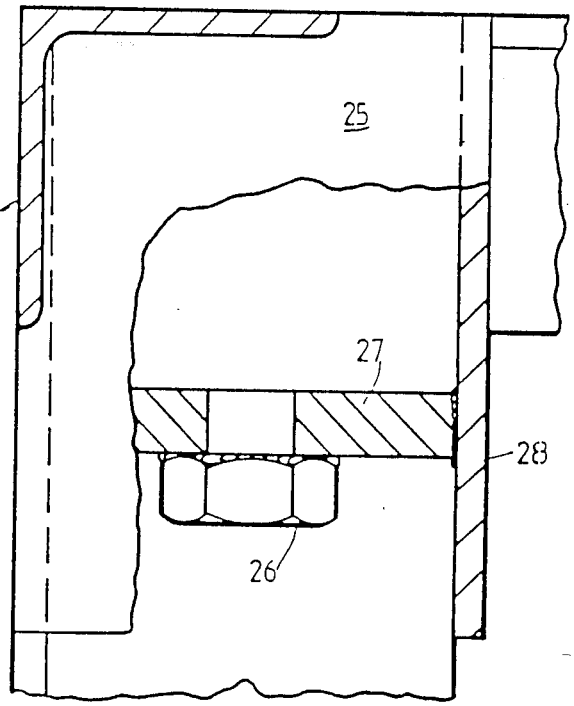
FIG. 3 shows a module corner lifting point.

Each module has a lifting point 25 at each corner (one only being shown in FIG. 3) this comprising a nut 26 welded to a plate 27 in the corner stud 28 of each module.

Figure 6:
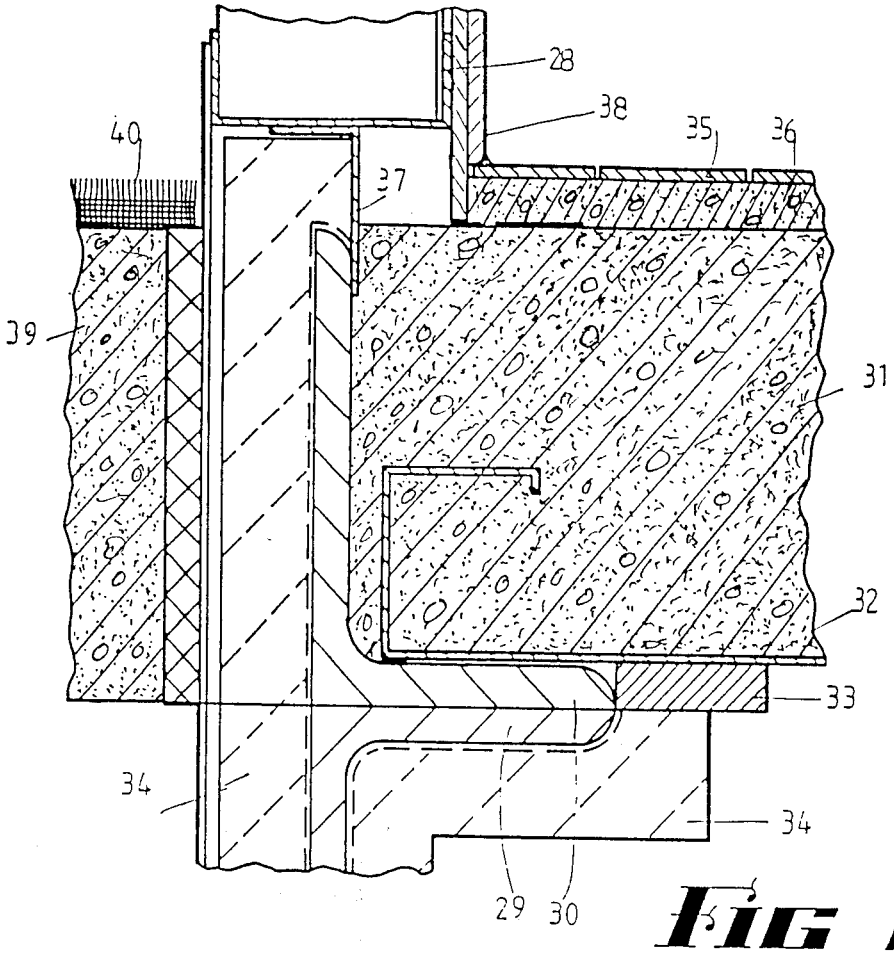
FIG. 6 shows in cross-section the interface of module to module.

The method of stacking one module on another is shown in FIG. 6 which shows the interface along one side, the upper frame 29 of the lower module being in abutting arrangement with the frame 30 of the upper module. The concrete floor 31 of the upper module is supported on profiled steel decking 32 supported by the frame 30, fire proof boards 33 being underneath the decking 32 and also fire rated material 34 being positioned on the outer side of the frames 29 and 30 and inside frame 29. On the upper surface of the concrete floor 31 are positioned tiles 35 on grouting 36. Stud 28 is attached by a cleat 37, skirting material 38 being positioned on each side of stud 28. Also shown is the floor 39 of the adjoining floor of the building, carpet 40 being positioned thereon.

The modules are superimposed one upon the other and joined together by positioning the base location 20 of the upper module into the lifting point of the lower module and bolting the two together which constitute a firm attachment means.

Figure 7:
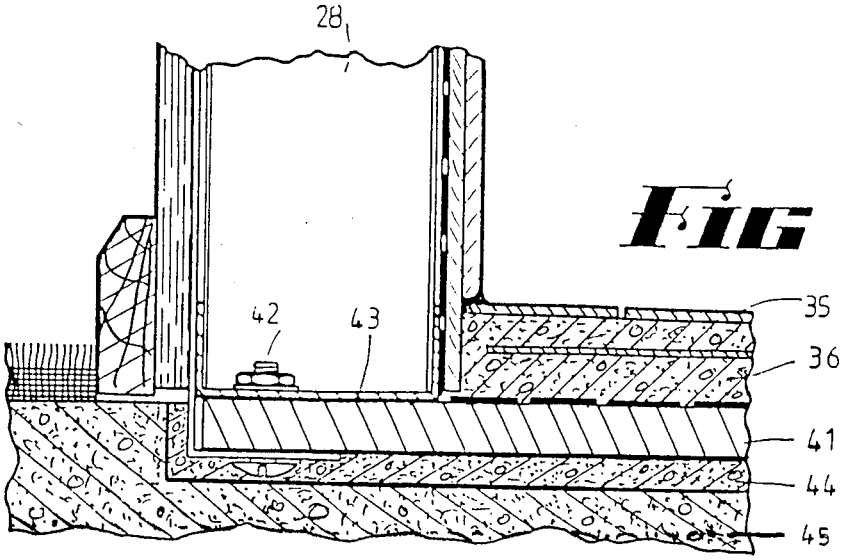
FIG. 7 shows the bolting of the flooring of a module to the wall frame.

FIG. 7 shows another view of one way of attaching the floor system to the wall frame. The floor of each module comprising compressed fibro sheeting 41 bolted to the base of stud 28, mortar 36 being layed on the fibro sheeting to support the tiles 35. The fibro sheeting 41 is bolted by bolts 42 to base plate 43 of stud 28. The floor is supported by grout 44 on concrete floor 45.

Figure 8:
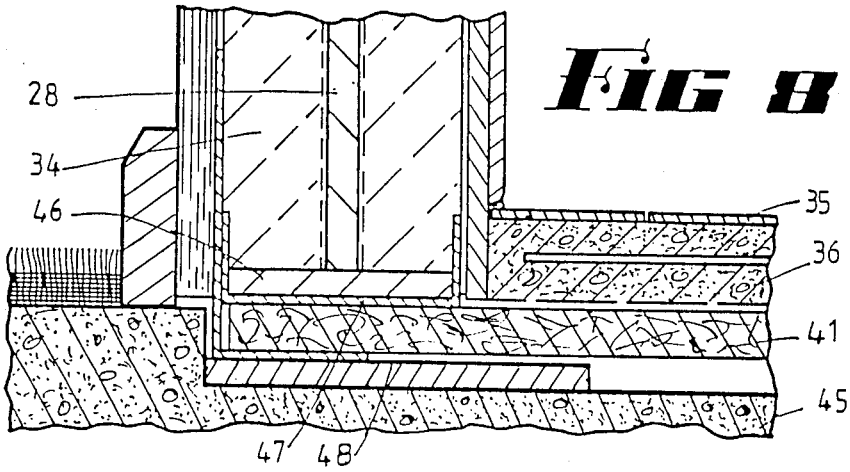
FIG. 8 shows the lowest module on the floor of the parent building.

FIG. 8 shows the position of the lowermost module on the concrete base floor 45 of the base building. The figure also shows further details of the stud 28 which comprises an aluminium column with a base plate 46 filled with fire rated material 34, this being positioned on a plate 47, the fibro sheeting 41 being bolted thereto as shown in FIG. 7. A leveling pad 48 is positioned in the recess in the concrete base floor 45, the floor of the module being grouted to the base floor 45 as desired.

Figure 9:
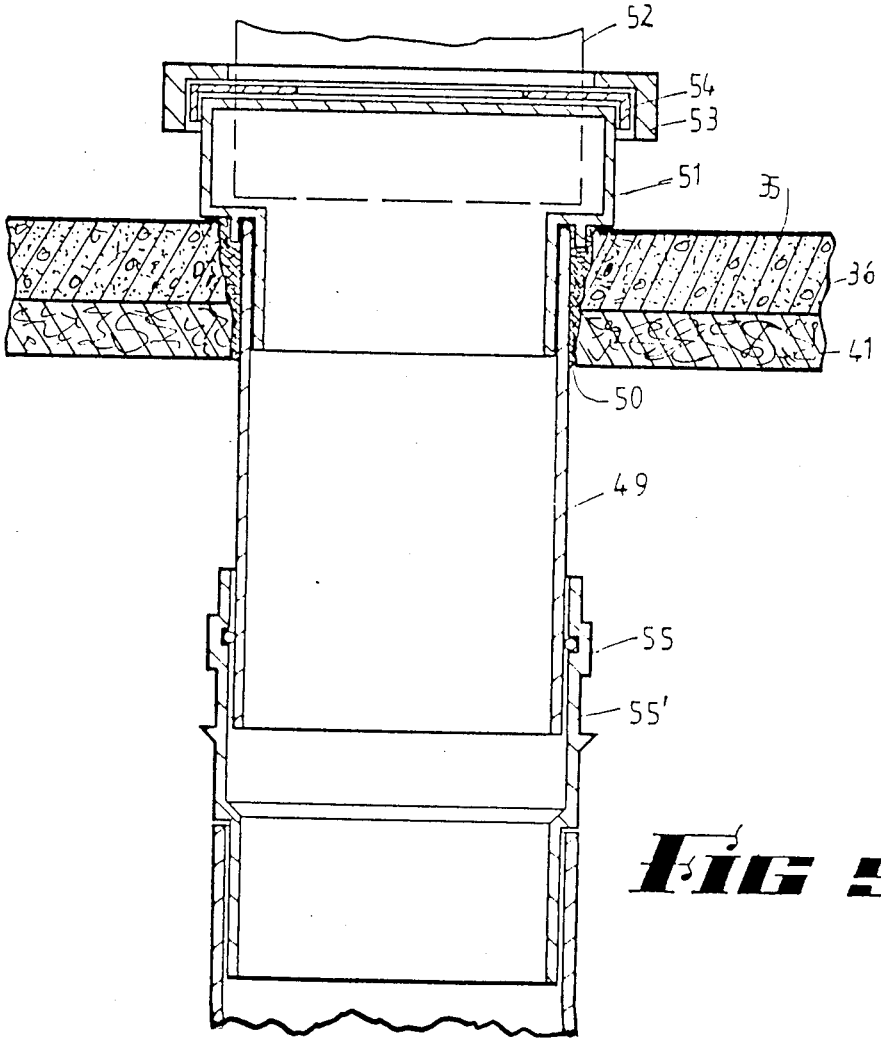
FIG. 9 shows the w.c. pan outlet.

Referring to FIG. 9, this shows the w.c. pan waste drainage through the floor comprising the fibro sheets 41, mortar 36 and tiles 35. A pipe 49 is embedded by an epoxy seal 50 into the opening in the floor, a fitting 51 being situated over the pipe 49. The pan outlet 52 is retained by a clamping collar 53 and flexible collar 54 to the fitting 51. The flexible coupling 55 and pipe 55 is supplied and fitted by the plumber on site. This is an example of the drainage of an upper module, the connections being made by the plumber in the false ceiling space described above.

Figure 10:
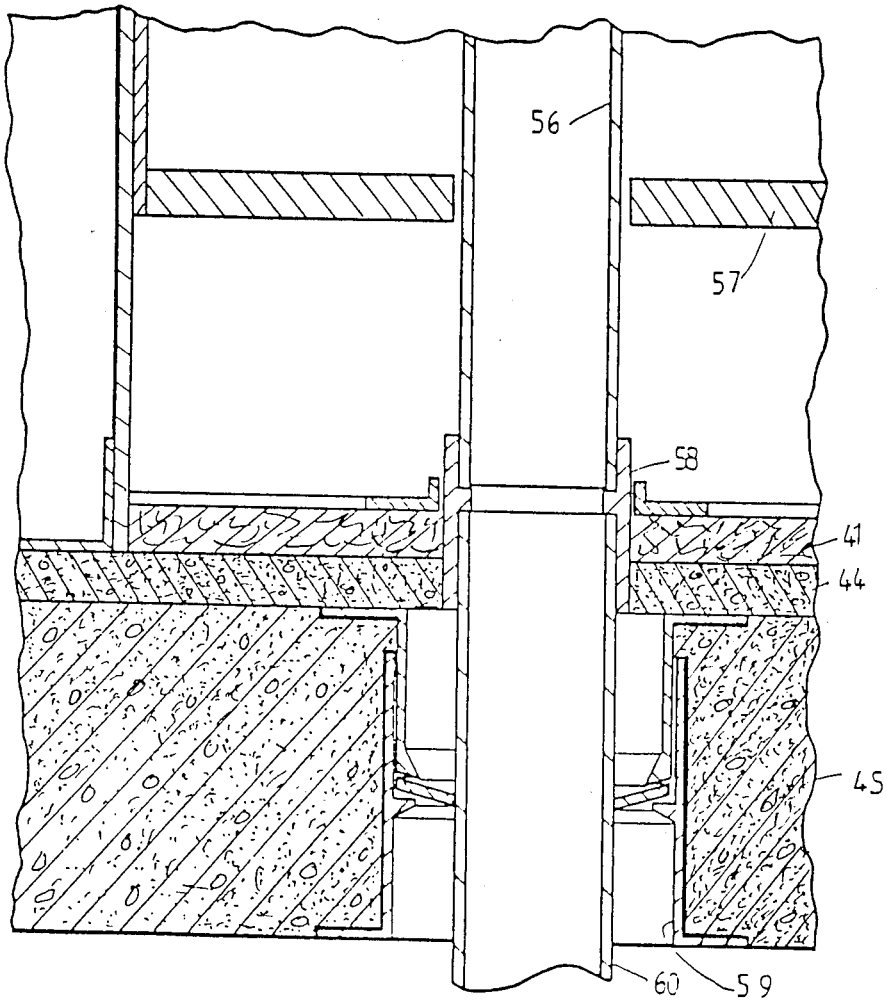
FIG. 10 shows the vanity unit waste drainage.

FIG. 10 shows a vanity unit waste drainage for the lowermost module situated on the insitu concrete floor 45 of the building. The vanity unit coupling pipe 56 passes down through the cupboard floor 57 and is attached to a coupling unit 58 embedded in the fibro floor 41 resting on mortar bed 44 on concrete floor 45. A slab seal 59 is fitted into the slab floor 45, the outlet pipe 60 being fitted thereto by the plumber after the module has been positioned.

An example of the bath waste drainage for the base module is also shown, the bath 61 having a plugway 62 screwed to a fitting 63 passing through the bath safe tray 64 and connected to a socket extension 65 with collar 66 connected to socket 67 in the floor of the module. A PVC slab seal 68 for pipe 69 is formed in the slab, the pipe 69 being fitted by the plumber on site.

Figure 12:
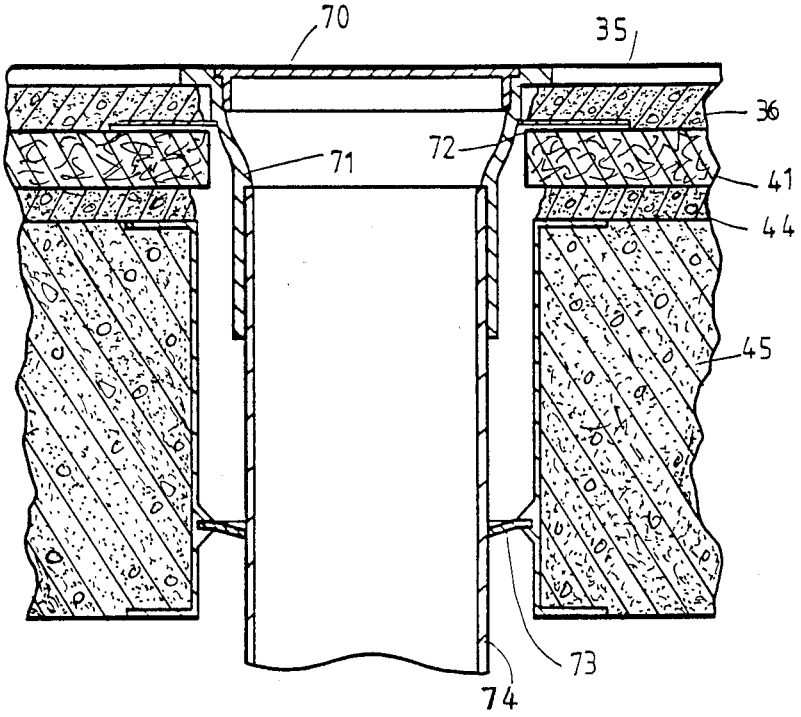
FIG. 12 shows the floor waste drainage.

Similarly FIG. 12 shows a floor waste drainage with the removal grating 70 resting in fitting 71 to which is adhered a PVC collar 72 adhered to fibro sheeting 41. A slab seal 73 is fitted to the slab to receive the waste pipe 74, the pipe 74 being fitted by the plumber on site.

Figure 11:
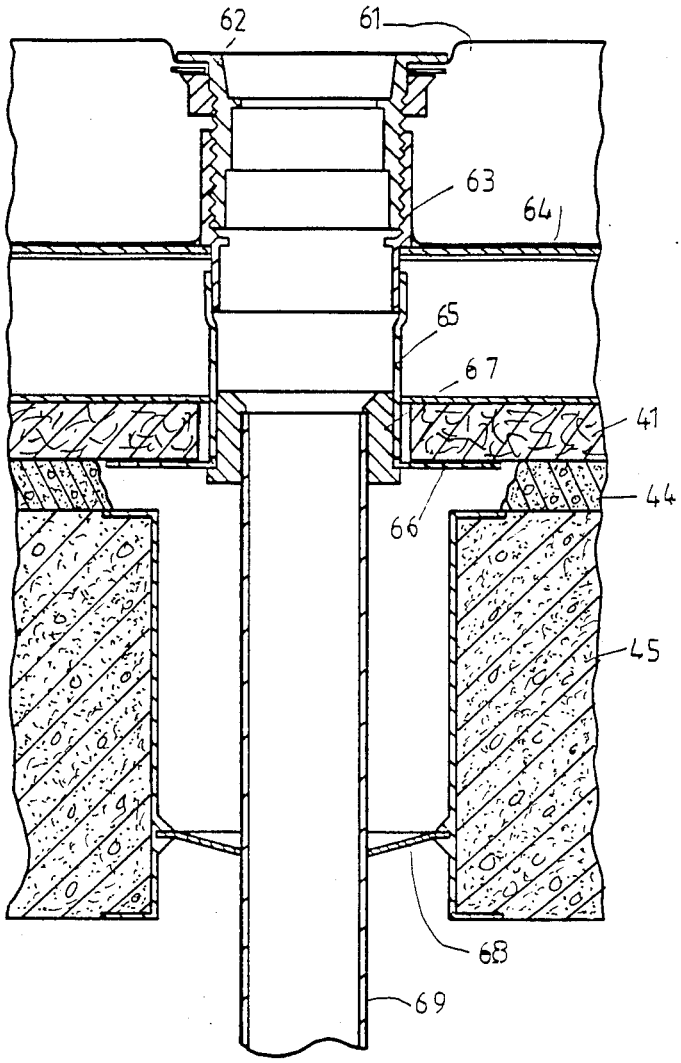
FIG. 11 shows the bath waste drainage.

In FIGS. 10 to 12, which described the connection through the base concrete floor, also can be applied to the upper modules. In this case as the base floor 45 is not present, the outlet pipes are fitted into the ceiling space above the false ceiling, suitable elbows and traps being provided as desired in the ceiling space.

Figure 13:
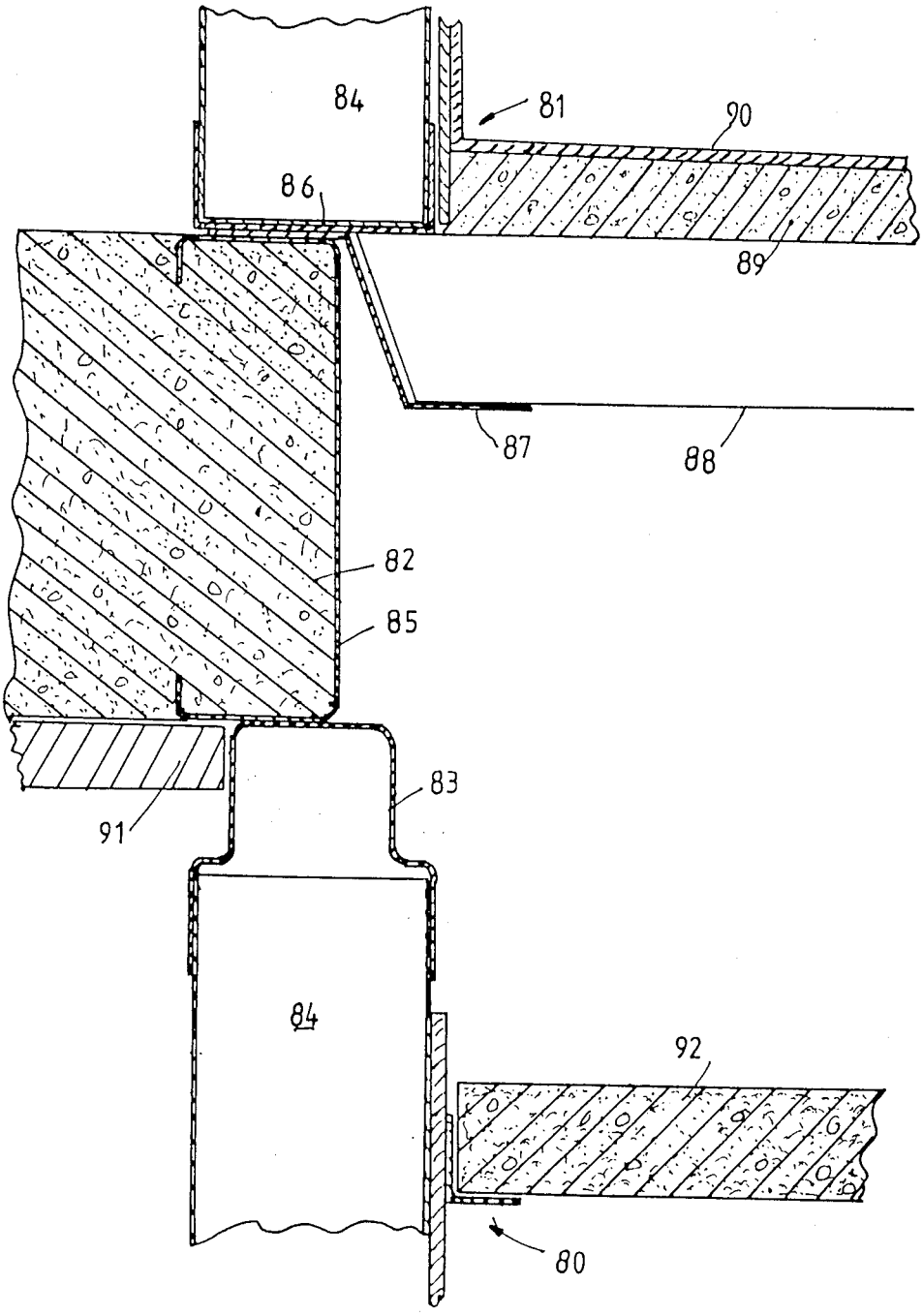
FIG. 13 shows an alternate method of joining the modules to the surrounding floor.

FIG. 13 shows an alternative construction for mounting the modules on each other with modules being tied into the surrounding floor of the building.

Referring to FIG. 13 there is shown a first module 80 with a second module 81 placed vertically thereabove and is supported thereto by a surrounding concrete floor slab 82.

On the top of the wall plate 83 of the wall 84 of each unit, there is attached for example by welding, bolting or the like a perimeter beam 85, this passing completely around the upper perimeter of the wall 84 of the module. Also each module has, extending from the bottom plate 86 of each wall 84 an angle perimeter beam 87 to support the floor panel 88 and floor finishing material 89 and tiles 90 of the floor of the module.

It will be realised that the perimeter beam 85 and angled perimeter beam 87, floor 88, 89 and 90 of each unit as well as all the plumbing fittings, water supply services, sinks, basins, tubs and the like are completed in each module before placement.

The perimeter beam 85 can be used to assist in supporting the insitu plywood formwork 91 surrounding the module for the pouring of the concrete floor slab 82 incorporating suitable reinforcement (not shown).

When a module is positioned, the top may be covered with a platform or decking to provide access for the workmen pouring the concrete floor slab which surrounds the module, which slab is locked thereto by the perimeter beam which also forms the formwork for the opening in the floor slab above the module.

After the floor slab has cured and after the temporary decking is removed, the next module can be positioned, the bottom plate 86 resting on the perimeter beam 85 of the lower unit. Access is thus available under the floor of the unit 1(*a*). On removing the ceiling panels 92 connection of the plumbing services and the like are made after which the ceiling panels 92 of the lower unit can be replaced.

Thus, it will be seen that the reinforcing of the floor slab is designed to provide a void in the slab over most of the core area. When the floor slab is poured and cured the core unit for that floor is placed on the perimeter beam which has been strengthened by the addition of the concrete.

A further advantage of using this system is that once the lower floor core is placed in position the concrete workers are relieved of the responsibility of providing accurate nesting in the concrete slab as required with previous systems. A further advantage is that sleeves for drainage and pipe work do not have to be provided in the concrete slab. All pipe work connections are made at some convenient time after the cores are placed in position and this is simplified by providing a normal suspended panel ceiling in the lower unit which can be sound rated and fire rated as desired.

It is noted above as a safety measure, panels of formwork and plywood which are removable are screwed to the top face of the perimeter beam so that workmen engaged in operations adjacent the open ceiling of the lower module are not at risk. These temporary panels are covered with waterproof sheeting which stays in place until they need to be removed for the placement of the upper module.

In the first alternative method described each module supports the next module above in a vertical stacking procedure. This method allows the concrete floors to be poured at any convenient time after the initial two or more modules are placed on top of each other. This method gives the site builder more flexibility in choosing concrete pour times. The modules are structurally designed to support a number of modules placed one on top of another, but will not structurally support the building. However, once each concrete floor slab is poured and cured the effect of the concrete keying into the perimeter beam of each module provides positive locking of the module into the surrounding floor structure. Thus the long term structural support for each module is provided by the pouring and curing of each successive floor as they progress upwards. A further advantage of stacking at least one module above the level where concrete is being poured is that greater protection for workmen is provided by not relying on the strength of the temporary platform or decking to support the weight of undetermined numbers of workmen and materials and equipment.

Although various forms of the invention have been described in some detail it is to be realised that the invention is not to be limited thereto but can include various modifications falling within the spirit and scope of the claims defining the invention.

The claims defining the invention are as follows:

1. A multi-story building comprising at least two self-contained, load-bearing building modules, means for superimposing said modules upon each other, said means comprising attachment means at each upper corner of each of the modules engaging in corresponding attachment means at each corner of the lower module, said upper attachment means forming lifting points for transporting and placing each module, each module including a floor and a wet area with plumbing and electrical supply fittings therefor extending beneath the floor, characterized in that each module has a false ceiling spaced below the upper portion of the respective module so as to form a space, into which space the plumbing and electrical supply fittings of the adjacent upper module protrude to provide access for connection to plumbing and electrical supply services on site.

2. A building system as defined in claim 1, characterized in that each module has a floor, said floor comprising compressed fibro sheeting bolted to a plate attached to said studs, tiles being laid on mortar on said compressed fibro sheeting.

3. A building system as defined in claim 1, characterized in that said lowermost module is positioned on a concrete slab floor of the building, a recess in said slab to accommodate said module so that the floor of the module is at the desired level in the building, levelling pads in said recess to position and level said module.

4. A building system as defined in claim 1, characterized in that each module has attached at its upper perimeter a perimeter beam, the perimeter beam forming the formwork for a surrounding concrete slab floor and interlocking therewith so that a further module may be positioned on the perimeter beam and attached to the building by said concrete floor.

5. A building system as defined in claim 1, characterized in that each module has at each base corner a base location comprising a reducer element and a nut, and each module has at each upper corner a lifting point adapted to engage the base location of a module placed thereon and joined by a bolt engaging said nut.

6. A building system as defined in claim 5, characterized in that each module is constructed with all fittings at a central construction area on a construction stand, said module and stand being transported while positioned on a transport stand to the erection site, shackles and chains joining said construction stand to said transport stand.

7. A building system as defined in claim 5, characterized in that each module includes an upper frame and a lower frame joined by structural studs, said upper and lower frames of adjacent modules abutting each other when one module is situated on a lower module.

8. A building system as defined in claim 7, characterized in that said frames and studs are load bearing frames to support additional modules thereon.

* * * * *